US006655529B2

(12) United States Patent
Ho

(10) Patent No.: US 6,655,529 B2
(45) Date of Patent: Dec. 2, 2003

(54) STRUCTURE OF A PORTABLE HAND-TOOL BAG

(76) Inventor: Cheng-I Ho, PO Box 82-144, Taipei (TW)

( * ) Notice: Subject to any disclaimer, the term of this patent is extended or adjusted under 35 U.S.C. 154(b) by 0 days.

(21) Appl. No.: 09/986,519

(22) Filed: Nov. 1, 2001

(65) Prior Publication Data

US 2003/0080010 A1 May 1, 2003

(51) Int. Cl.[7] ..... B65D 85/28; B65D 73/00

(52) U.S. Cl. ..... 206/373; 206/464; 206/473; 206/480

(58) Field of Search ..... 206/373, 348, 206/372, 374, 375, 461, 464, 465, 1.5, 477, 480, 483, 745, 482, 747, 376–79, 472, 473; 211/70.6; 220/735

(56) References Cited

U.S. PATENT DOCUMENTS 4,836,374 A * 6/1989 Hutchins et al. ..... 206/373
5,139,143 A * 8/1992 Pond ..... 206/373
5,203,469 A * 4/1993 Chang et al. ..... 206/372
6,109,436 A * 8/2000 He ..... 206/373
6,213,296 B1 * 4/2001 Streich et al. ..... 206/373
6,378,700 B1 * 4/2002 Tong ..... 206/376

* cited by examiner

*Primary Examiner*—Shian Luong
*Assistant Examiner*—Gregory Pickett
(74) *Attorney, Agent, or Firm*—Leong C. Lei

(57) ABSTRACT

A structure of a portable hand-tool bag is disclosed. The hand-tool bag comprises a hand-held body, and two tool boxes, wherein the hand-held body includes an external layer, two inner board, two positioning board and an inner layer, characterized in that at least two adjacent ends of the positioning board are mounted with a corner member having mounted with an elastic top plate thereon and the top edge of the elastic top plate being a protrusion; and the two tool boxes are substantially rectangular with a plurality of slots within the center of the box to accommodate tools, one lateral edge of the tool box is provided with a notch corresponding to the protrusion on the top edge of the elastic top plate so that the protrusion is engaged with the notch; thereby the tool boxes containing tools within the slots of the tool boxes are engaged to the corner member and the two tool boxes are mounted to the hand-held body, facilitate the carrying of tool.

1 Claim, 11 Drawing Sheets

STRUCTURE OF A PORTABLE HAND-TOOL BAG

BACKGROUND OF THE INVENTION (a) Field of Invention

The present invention relates to hand-tool bag, and in particular to the structure of a portable hand-tool bag.

(b) Description of the Prior Art

FIGS. 1 and 2 show types of conventional toolbox containing various types of tools. Conventional type of toolbox provides only one function, i.e., a box used to contain or store tools. As a result, the bag serves only one purpose. Other types of tool bags are used to contain many types of tools and when in use, it is rather laborious to search the right tool, and in some cases, the entire box of tools has to be carried along and it is rather troublesome. Accordingly, it is an object of the present invention to provide you with an improved structure of a portable hand held tool bag which can facilitate carrying along and allows the related tools to be carried along.

SUMMARY OF THE INVENTION

Therefore it is an object of the present invention to provide a portable hand-tool bag, which provides the user an option to carry the related hand tools.

It is an object of the present invention to provide a portable hand-tool bag including a hand-held body, and two tool boxes, wherein the hand-held body includes an external layer, two inner boards, two positioning boards and an inner layer, characterized in tat at least two adjacent ends of the positioning board are mounted with a corner member having mounted wit an elastic top plate thereon and the top edge of the elastic top plate being a protrusion; and the two tool boxes are substantially rectangular with a plurality of slots within the center of the box to accommodate tools, one lateral edge of the tool box is provided with a notch corresponding to the protrusion on the top edge of the elastic top plate so that the protrusion is engaged with the notch; thereby the tool boxes containing tools within the slots of the tool boxes are engaged to the corner member and the two tool boxes are mounted to the hand-held body, facilitate the carrying of tool.

Yet a further object of the present invention is to provide a portable hand-tool bag, wherein the comer member is located diagonally or at the wider side of the positioning board adjacent to the folding line of the hand-held body.

Still another object of the present invention is to provide a portable hand-tool bag, wherein the bag body is folded substantially at the center thereof to form into a bag, facilitating the bag to be carried along.

DETAILED DESCRIPTION OF THE PRESENT INVENTION

Figure 1:
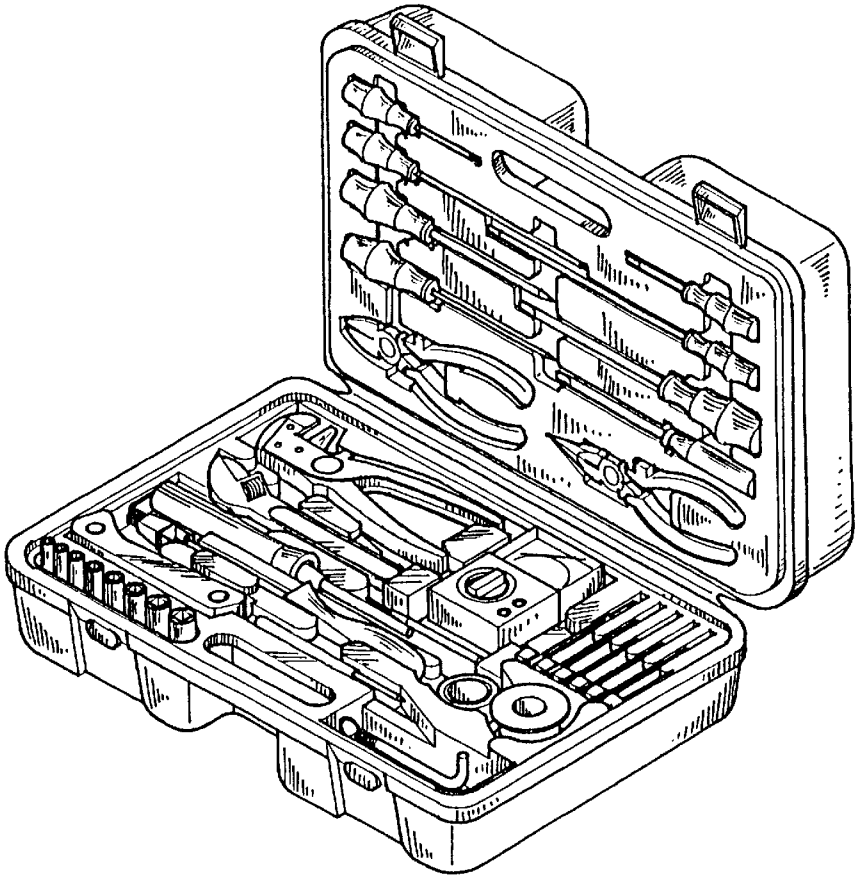
PRIOR ART FIG. 1
FIG. 1 is a perspective view of a conventional portable toolbox.
Figure 2:
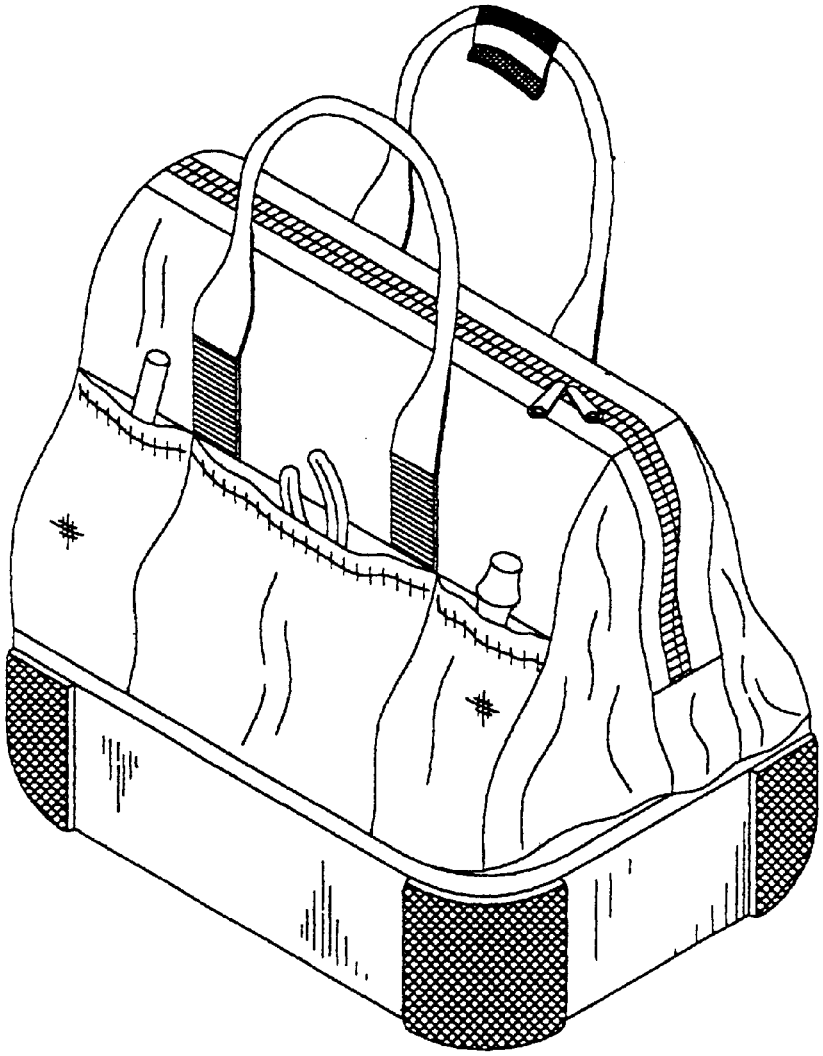
PRIOR ART FIG. 2
FIG. 2 is a perspective view of another conventional portable toolbox.
Figure 3A:
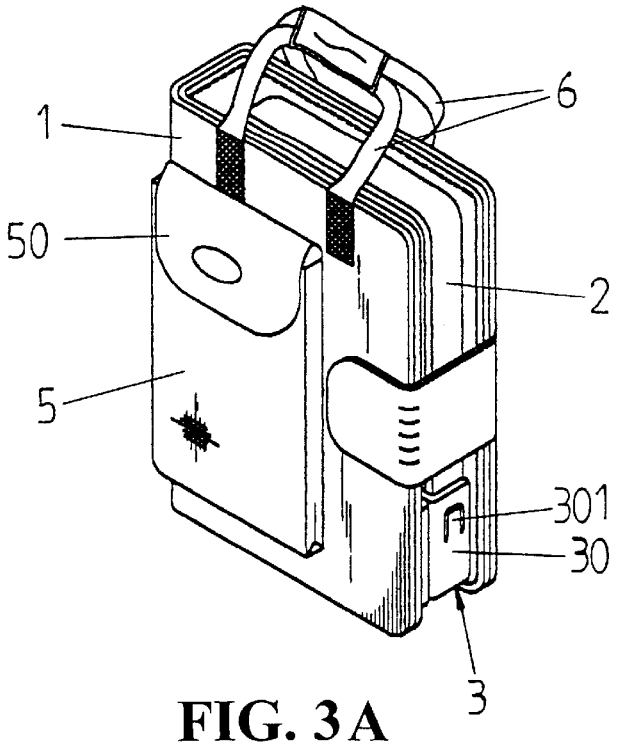
FIG. 3A shows a perspective view of a portable hand-tool bag according to the present invention.
Figure 3B:
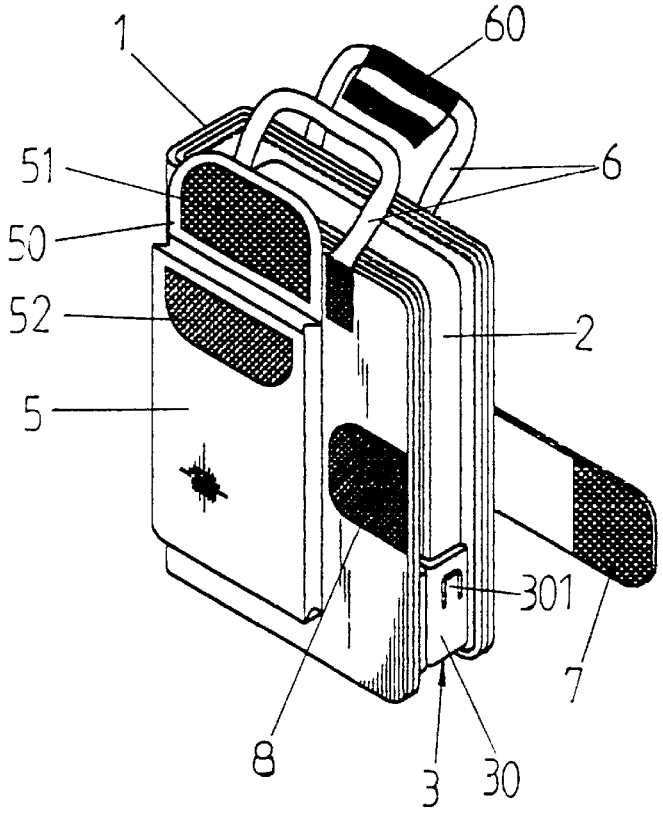
FIG. 3B is a perspective view of the present invention shown in open condition.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring now to FIGS. 3A, 3B, 4, 5, 6A and 6B, there is shown a portable hand-tool bag including a hand-held body 1, and two tool boxes 2, wherein the hand-held body 1 includes an external layer 11, two inner boards 12, two positioning boards 13 and an inner layer 14. In accordance with the preferred embodiment, at least two adjacent ends of the positioning board 13 are mounted with corner members 3, 4 and the corner members 3, 4 include vertical walls 30, 40, upper bending tops 31, 41 and end walls 30, 40. The vertical wall 30 of the corner member 3 is provided with an elastic top plate 301 and the top edge of the elastic top plate 301 is provided with a protrusion 302.

The two tool boxes 2 are substantially rectangular boxlike structure with a plurality of slots 20 within the center of the box 2 to accommodate tools, and one lateral edge of the tool box 2 is provided with a notch 21 corresponding to the protrusion 302 on the top edge of the elastic top plate 301 so that the protrusion 302 is engaged with the notch 21.

Figure 7B:
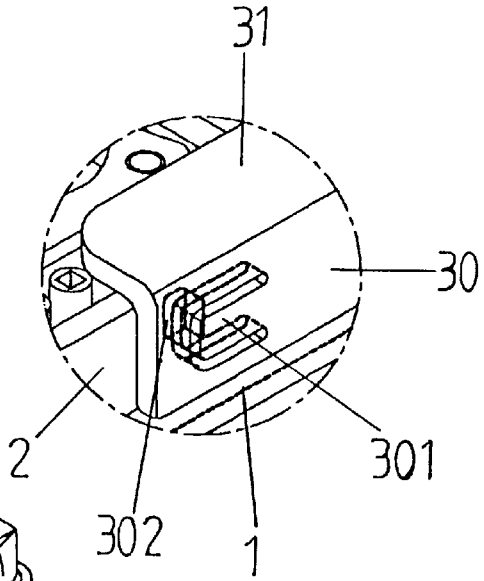
FIG. 7 is a perspective view of the hand tool bag of the present invention, wherein the toolboxes are position on the hand held body and the boxes are positioned by means of the corner members.
Figure 7A:
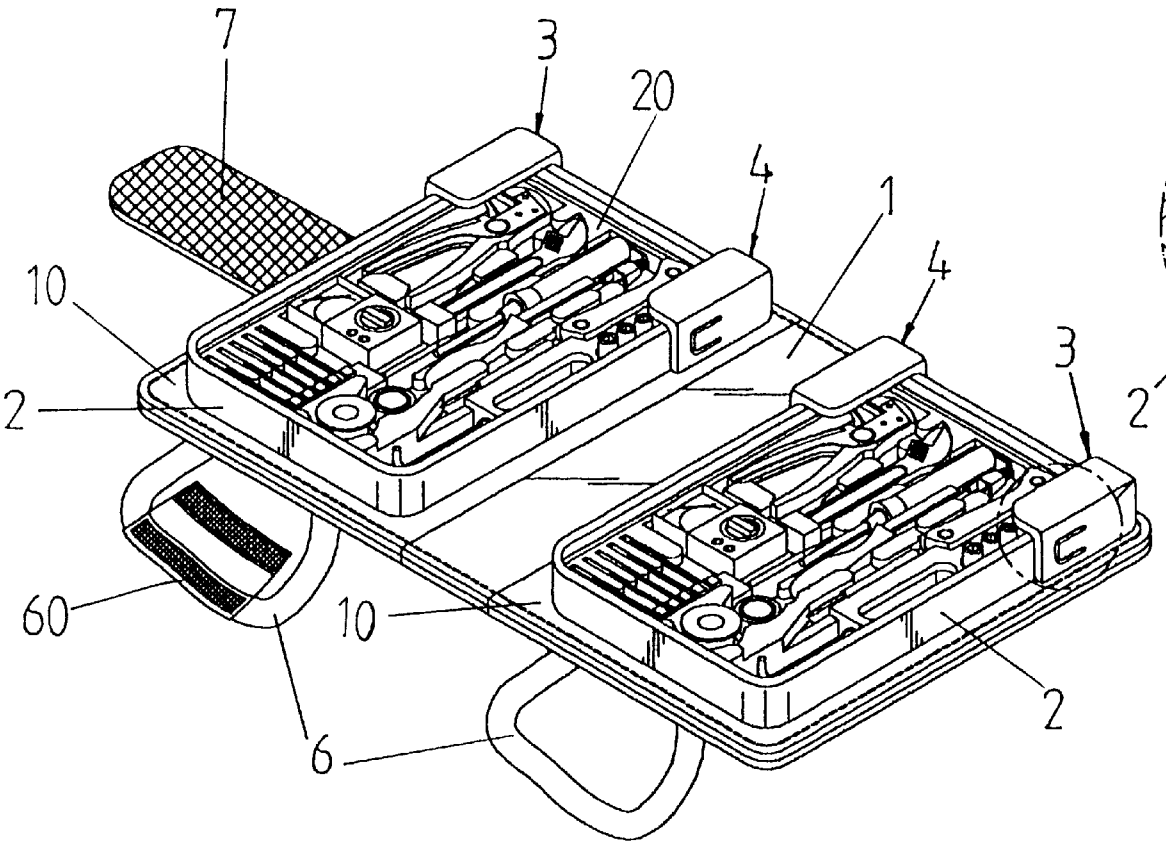

Accordingly, in accordance with the present invention, the tool boxes 2 containing tools within the slots 20 of the tool boxes 2 are engaged to the corner members 3,4 and the two tool boxes 2 are mounted to the hand-held body 1, facilitate the carrying of tool. The positioning of the tool boxes 2 onto the hand-held body 1 can be seen in FIG. 7.

In accordance with a preferred embodiment of the present invention, the external layer 11 can be mounted with a pocket body 5 with a cover 50 and VELCRO fasteners 51, 52 are used to fasten the cover 50 to the pocket body 5 as shown in FIG. 3.

The top edge of the hand-held body 1 is provided with a carrying member 6 mounted with VELCRO fastener 60 so as to hold the respective carrying members 6 together to facilitate the carrying of the hand tool bag.

Figure 4:
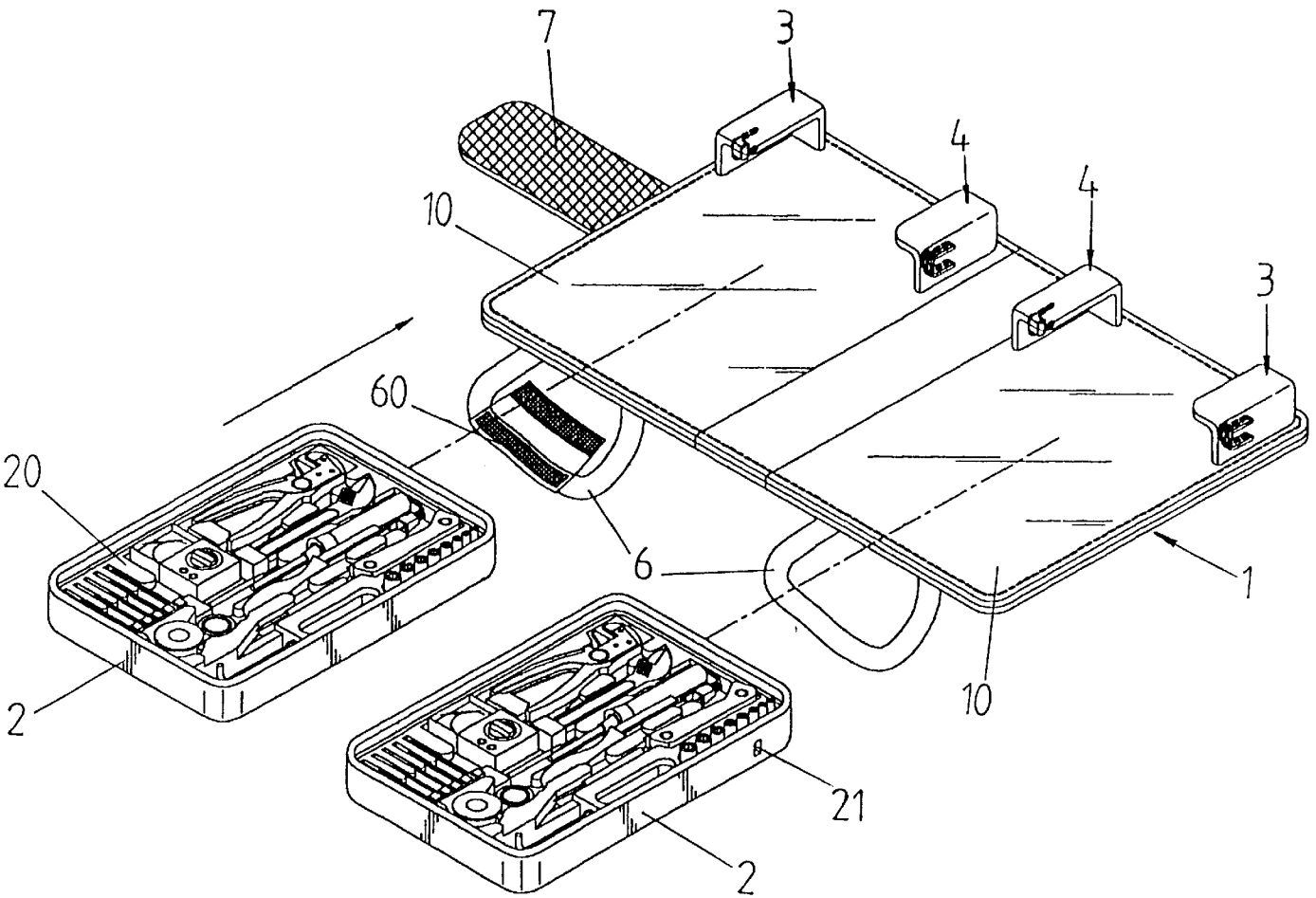
FIG. 4 is a perspective exploded view of the portable hand-tool bag, showing the tool boxes being separated from the hand held body in accordance with the present invention.
Figure 5:
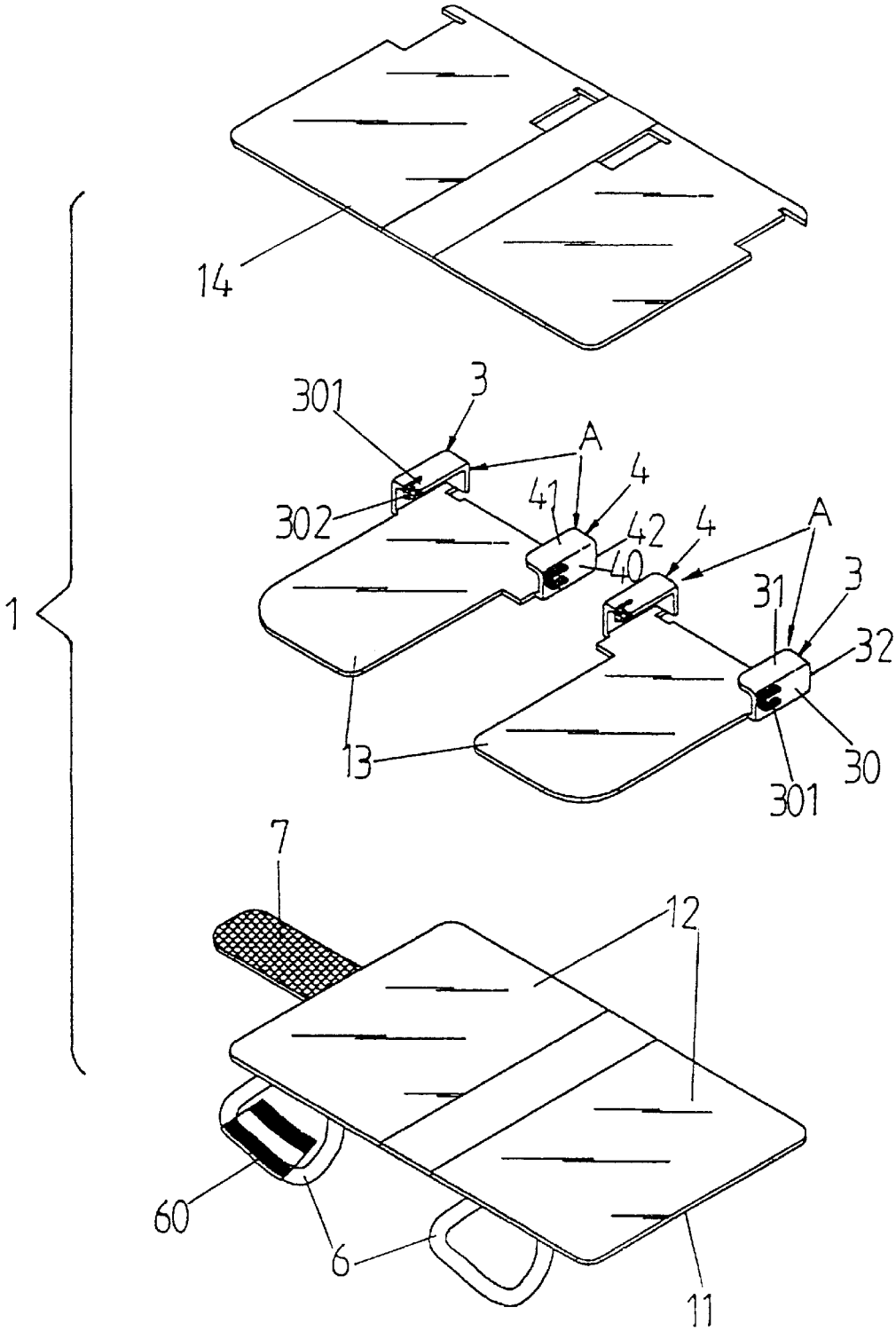
FIG. 5 is an exploded perspective view of the hand held body of the portable hand-tool bag of the present invention.
Figure 6A:
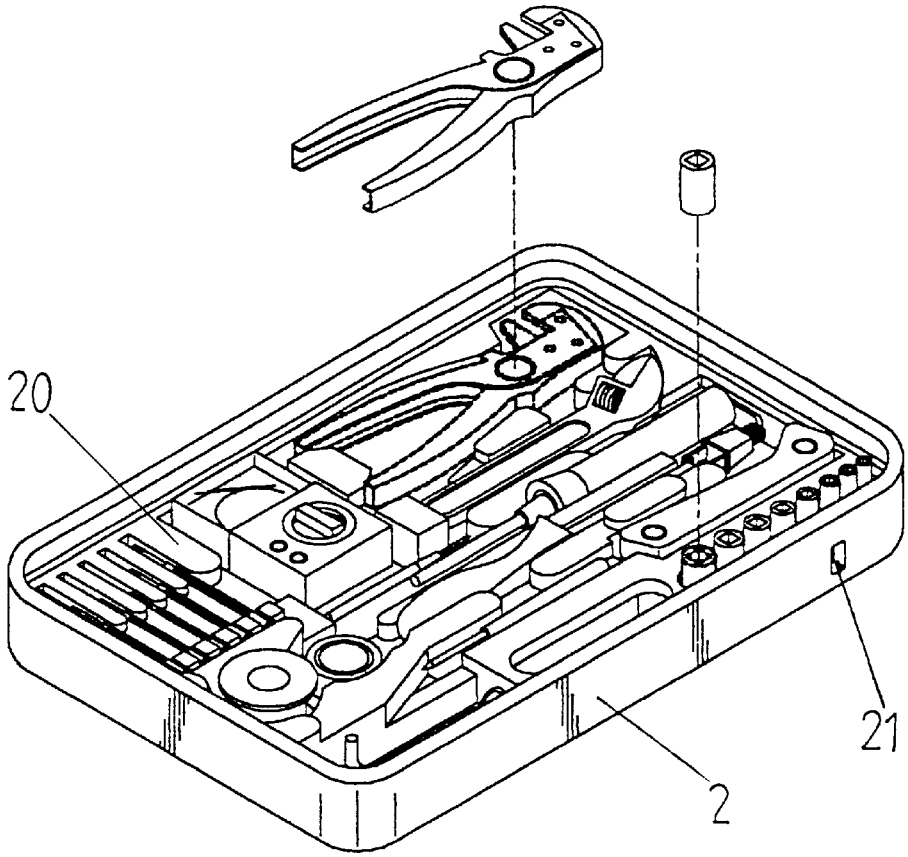
FIG. 6A is a perspective view of the elastic plate with protrusion and the toolbox containing various types of hand tools in accordance with the present invention.
Figure 6B:
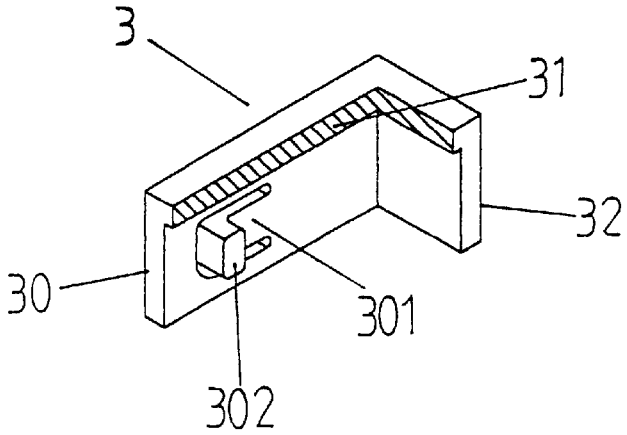
FIG. 6B is a perspective view of the corner member of the present invention.

As shown in FIG. 4, the center region of one lateral edge of the hand held body 1 is provided with VELCRO fastener 7, 8 so that the hand held body 1 after folded can be fastened together to enclose the tool boxes 2.

Figure 8:
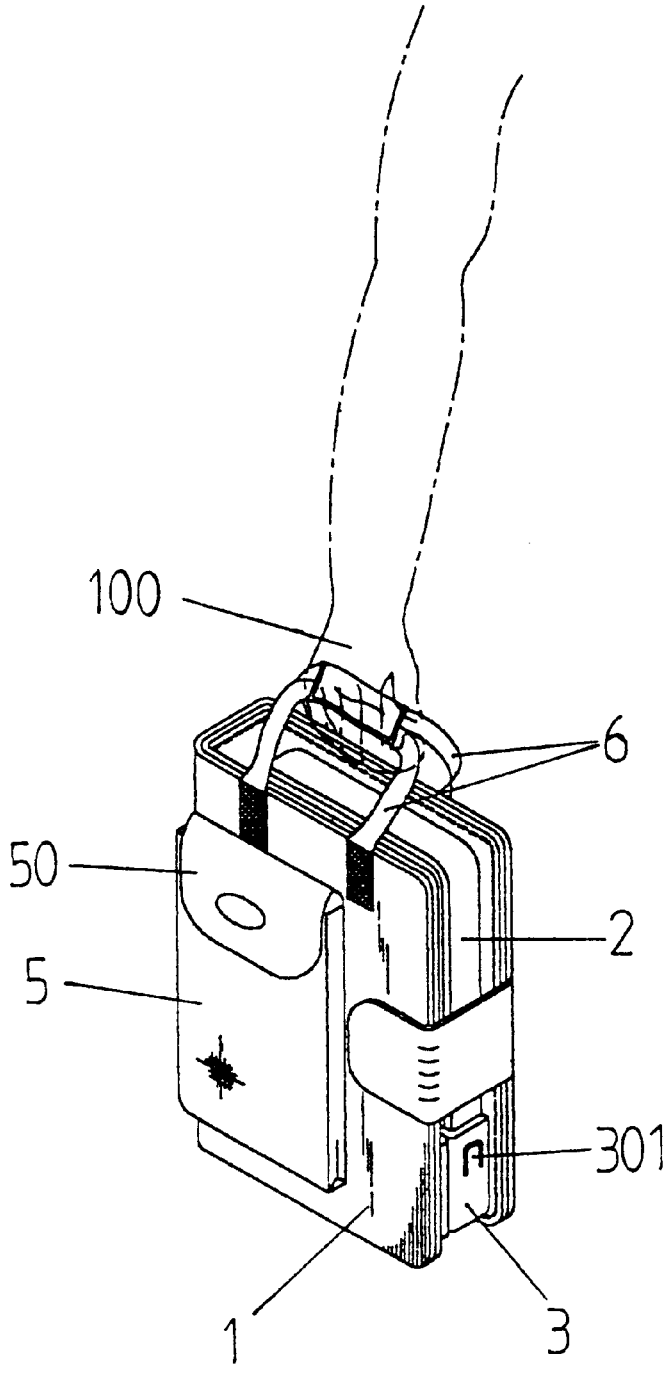
FIG. 8 is a schematic view showing the carrying of the hand-tool bag in accordance with the present invention.
Figure 9:
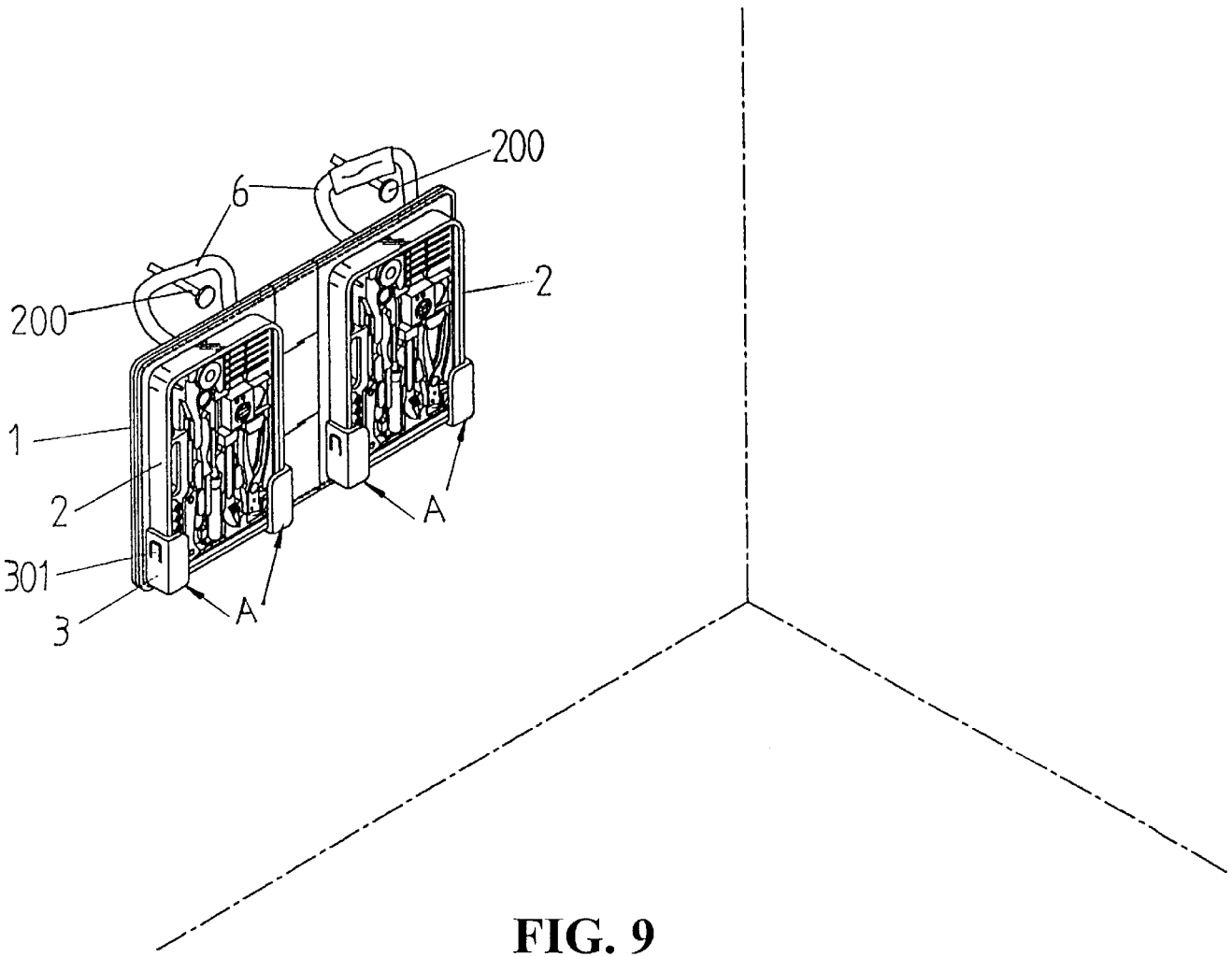
FIG. 9 is a perspective view showing the hand-tool bag being hung on a wall in accordance with the present invention.

FIG. 8 is a schematic view showing the tool bag can be carried with the pump 100 of the user at the carrying members 6. FIG. 9 is a perspective view showing the hand-tool bag being hung on a wall in accordance with the present invention, wherein the carrying members 6 are hung over pins 200 or support on the wall.

Figure 10:
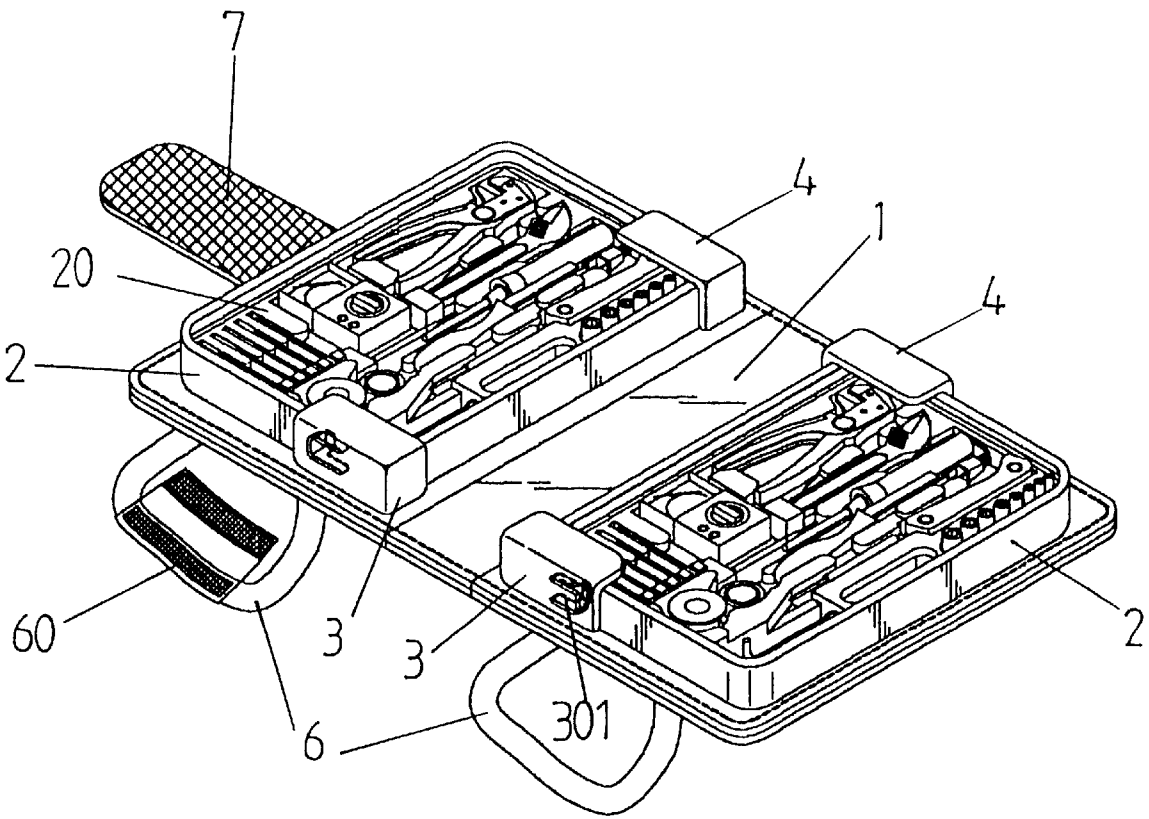
FIG. 10 is a perspective view of the portable hand-tool bag, wherein the corner members are located at the wider side, close to the center of the handheld bag, in accordance with the present invention.
Figure 11:
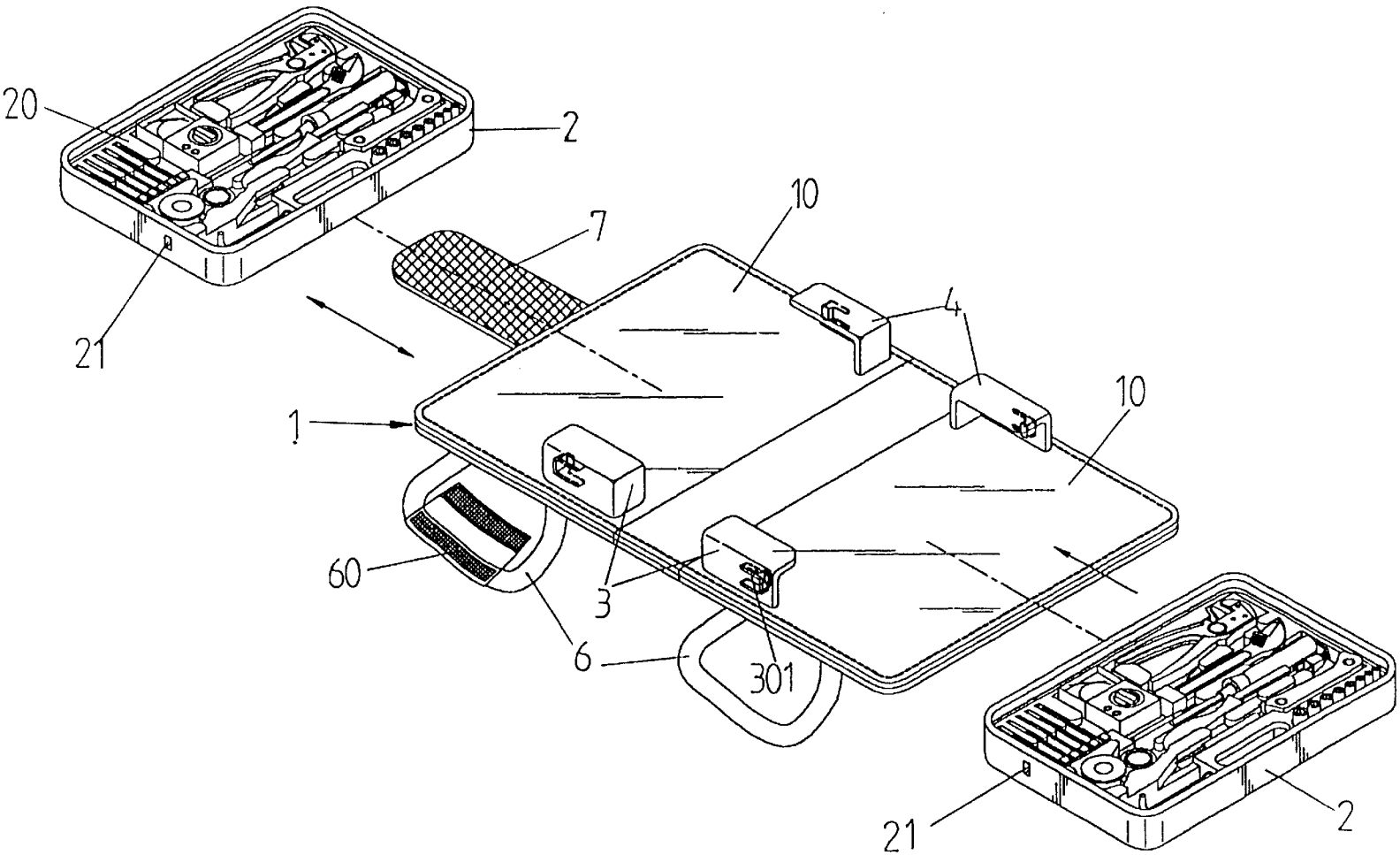
FIG. 11 is a perspective view showing schematically the withdrawing of the toolbox from the sides of the hand held body of the present invention.

FIGS. 10 and 11 show the position of the corner members 3, 4 on the positioning boards 13. The members 3, 4 are mounted at the wider lateral side of the positioning boards 13 close to the folding region of the hand held body 1. In this case, the tool boxes 2 will be inserted from the corresponding side of the hand held body 1. Similarly, protrusion 302 is provided to the elastic plate 301.

In accordance with the present invention, the side of the comer members 3,4 can be changed to comply with the size of the tool boxes 2 so that the boxes 2 are positioned onto the positioning board 13 when the hand held body 1 is folded for fastening.

It will be apparent to those skilled in the art that various modifications and variations can be made in the disclosed process without departing from the scope or spirit of the invention. Other embodiments of the invention will be apparent to those skilled in the art from consideration of the specification and practice of the invention disclosed herein. It is intended that the specification and example be considered as exemplary only, with a true scope and spirit of the invention being indicated by the following claims.

I claim:

1. A portable hand-tool bag including a hand-held body, and two tool boxes, wherein the hand-held body includes an external layer, two inner boards, two positioning boards, and an inner layer, characterized in that two adjacent ends of the positioning boards are each mounted with a corner members having an elastic top plate mounted thereon, the top edge of the elastic top plate being a protrusion, the two tool boxes are rectangular and formed with a plurality of slots within a center of the tool boxes to accommodate tools, the tool boxes having two lateral sides, each side provided with a notch corresponding to a protrusion on the top edge of an elastic top plate so that the protrusion is engaged with the notch; whereby the tool boxes containing tools within the slots of the tool boxes are engaged with the corner members and the two tool boxes are mounted to the hand-held body, facilitating the carrying tools.

* * * * *